United States Patent [19]

Iura et al.

[11] Patent Number: 5,003,761

[45] Date of Patent: Apr. 2, 1991

[54] METHOD AND APPARATUS FOR MANUFACTURING COMPACT CONDUCTORS

[75] Inventors: Kazuo Iura; Kazunori Tsuji; Kazuhito Saka, all of Mie, Japan

[73] Assignee: Sumitomo Wiring System, Ltd., Mie, Japan

[21] Appl. No.: 379,630

[22] Filed: Jul. 13, 1989

[30] Foreign Application Priority Data

Jul. 18, 1988 [JP] Japan ..... 63-178670

[51] Int. Cl.[5] ..... D01H 1/04

[52] U.S. Cl. ..... 57/58.52; 57/58.7; 57/58.86

[58] Field of Search ..... 57/58.52, 58.54, 58.55, 57/58.57, 58.7, 58.83, 58.86

[56] References Cited

U.S. PATENT DOCUMENTS

| | | | |
|---|---|---|---|
| 3,138,914 | 6/1964 | Blaisdell | 57/58.7 |
| 3,355,867 | 12/1967 | Yoshida . | |
| 3,491,525 | 1/1970 | Sugi . | |
| 3,715,877 | 2/1973 | Akachi . | |
| 4,087,956 | 5/1978 | Gre | 57/58.86 X |
| 4,133,167 | 1/1979 | Schofield . | |
| 4,328,662 | 5/1982 | Bretegnier et al. . | |
| 4,339,913 | 7/1982 | Vogelsberg . | |
| 4,590,754 | 5/1986 | Bouffard et al. | 57/58.7 X |
| 4,599,853 | 7/1986 | Varga-Papp . | |
| 4,704,855 | 11/1987 | Yoshida et al. . | |

FOREIGN PATENT DOCUMENTS

| | | |
|---|---|---|
| 58-129704 | 8/1983 | Japan . |
| 60-160515 | 8/1985 | Japan . |
| 61-13596 | 4/1986 | Japan . |
| 801645 | 9/1958 | United Kingdom . |
| 1581840 | 12/1980 | United Kingdom . |

*Primary Examiner*—Stuart S. Levy
*Assistant Examiner*—Steven M. DuBois
*Attorney, Agent, or Firm*—Wenderoth, Lind & Ponack

[57] ABSTRACT

A double-twist type compact conductor manufacturing apparatus is comprised of a supply device for supplying conductor strands, a conductor twist machine, a converging and compacting die for converging and compacting a plurality of the conductor strands, and a capstan having a groove shaped so as to maintain the form of the converged and compacted conductor, as well as to provide feeding of the same. The converging compacting die is disposed upstream of the capstan but downstream from the conductor supply device and the conductor twist machine is downstream of the converging compacting die. The conductor twist machine is a double twist machine for imparting a double twist to the conductor. This configuration of the apparatus serves to prevent not only deformation of the twisted wire but also the breakage thereof.

6 Claims, 2 Drawing Sheets

METHOD AND APPARATUS FOR MANUFACTURING COMPACT CONDUCTORS

BACKGROUND OF THE INVENTION

1. Field of the Invention

The present invention relates to a double twist machine for manufacturing multi-stranded electrically conductive wires, such as electrically conductive wires for automobiles, appliances and so forth, and more particularly to a method and apparatus for manufacturing compact conductors.

2. Statement of the Prior Art

In manufacturing compact conductors with a conventional double twist machine 1*a* (see FIG. 4) in which a compacting die 4*a* and a converging die 4*b* are respectively provided on the inlet sides of a drawing device 6*a* and the double twist machine 1*a*, concentric conductors of a single-layer structure can be compacted through one process, while concentric conductors of a multi-layer structure must be compacted on a one-compaction-for-one layer basis through a plurality of processes.

A double twist compact conductor manufacturing machine having a strander upstream of a drawing device is disclosed in Japanese Patent Public Disclosure Nos. 160515/1985 and 129704/1983.

However, the above-mentioned prior art double twist machine 1*a* has difficulties in leading a wire through the compacting die 4*a*. On top of this, in a case where a defect such as strand separation or the like takes place in a twisted wire at a position prior to the compacting die 4*a*, the wire will break when it reaches the compacting die 4*a*.

This problem of wire breakage also takes place with concentric twisted wire with a multi-layer structure when the same are compacted through only one process. This is because it is impossible to exert uniform pressure on all the constituent strands of the wire when put through a single compaction, and hence strand separation takes place in the wire at the entry of the compacting die 4*a*, resulting in breakage of the wire. This problem can be solved by compacting the twisted wire on a layer-by-layer basis through two processes, but this type of manufacturing method reduces production efficiency.

In addition, the construction of the prior art drawing devices was complicated.

SUMMARY OF THE INVENTION

An object of the present invention is to provide a method and apparatus for manufacturing compact conductor wires in which a simply constructed drawing device and a converging and compacting die are provided so that compaction is conducted in such a manner that final products have well-shaped profiles, free from deformations, and hence that no breakage takes place, and that wire feeding is easily conducted.

A method for manufacturing compact conductor wires according to the present invention is comprised of supplying a plurality of strands from a conductor strand supply device, allowing the plurality of strands to pass through a lay plate having holes formed therein so as to arrange the strands in a divided fashion, converging and compacting the plurality of strands so divided by means of a converging and compacting die so as to form a compact conductor, bringing the compact conductor into contact with the peripheral groove of a capstan while allowing a twisting force generated from a conductor twist machine to be transmitted to the compact conductor, and allowing the conductor to proceed to the conductor twist machine in accordance with the rotation of a drawing capstan.

An apparatus for manufacturing compact conductors according to the present invention is provided with a converging and compacting die and a drawing capstan between a double-twist type conductor twist machine and a supply device for supplying conductor strands, and the capstan has a peripheral groove formed in its outer periphery in such a manner as to securely maintain the profile of a compact conductor, as well as to allow the same to travel therethrough while in contact therewith.

DETAILED DESCRIPTION OF THE PREFERRED EMBODIMENTS

Figure 1:
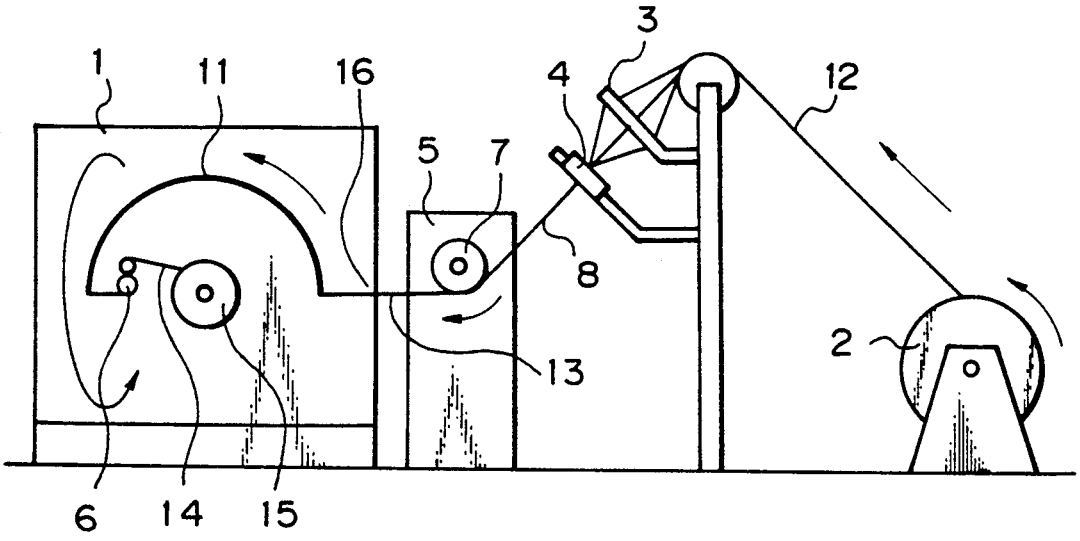
FIG. 1 is a schematic front view of one embodiment of a double-twist type compact conductor manufacturing machine according to the present invention.

With reference to FIG. 1, embodiments of a double-twist type compact conductor manufacturing method and an apparatus employing the same will be described.

In a double-twist type compact conductor manufacturing device according to the present invention, a plurality of conductor strands 12 are supplied from each supply bobbin 2 through a lay plate 3 which is adapted to divide the strands. The strands are then converged in such a manner as to form a twisted wire construction which is then fed into a converging and compacting die 4, where converging and compacting of the strand conductors 12 occurs so as to form a compact conductor 8. A capstan 7 having a Peripheral groove 9 and a drawing device 5 for driving the capstan 7 are provided on the outlet side of the converging and compacting die 4. This drawing device 5 is designed to rotate the capstan 7 at such a rotational speed that the peripheral speed of the capstan 7 becomes equal to or greater than the wire drawing speed of a double-twist machine 1, while operating in synchronism with the double twist machine 1.

Figure 3:
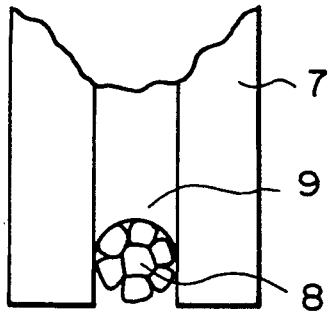
FIG. 3 is a partial enlarged side view showing the relationship between a peripheral groove and a compact twisted wire.
Figure 4:
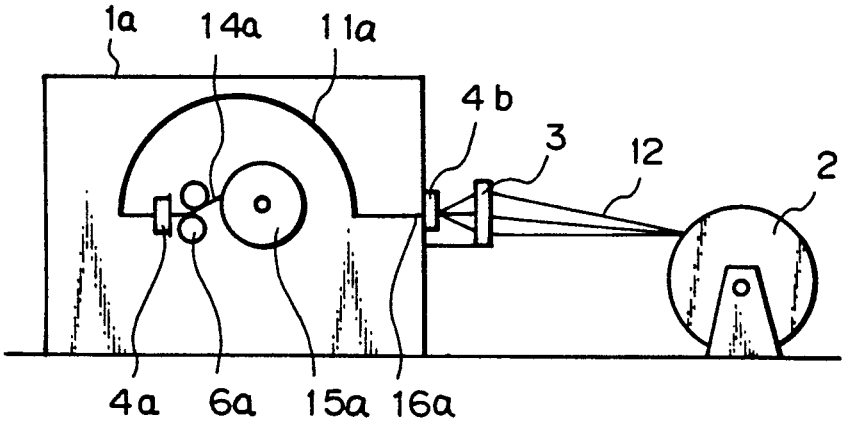
Fig. 4 PRIOR ART
FIG. 4 is a schematic front view of a prior art double-twist type conductor manufacturing machine.

As shown in FIG. 3, the peripheral groove 9 in the capstan 7 is substantially as wide as the diameter of a die hole of the converging and compacting die 4, is substantially as deep as or deeper than the diameter of the die hole and has a semicircular shaped bottom with the same curvature as that of the die hole.

Figure 2:
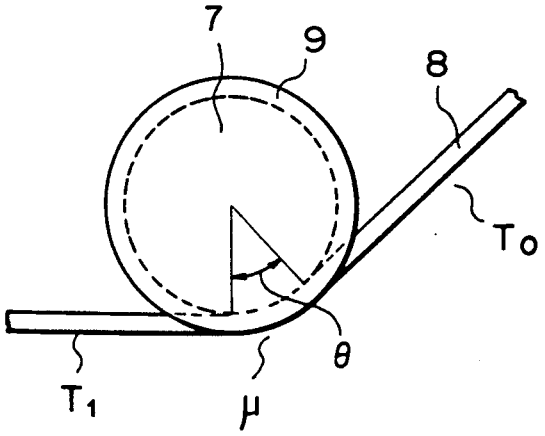
FIG. 2 is an enlarged view of a capstan section of a drawing device.

The positional relationship between the capstan 7 and the compact conductor 8 is shown in FIG. 2. The capstan 7 is located in such a position that the compact conductor 8 is accommodated in the peripheral groove 9 of the capstan 7, and the contact angle between the capstan 7 and the conductor 8 is set in such a manner as to generate an effective frictional resistance ($\mu$) therebetween. The capstan is also designed to be driven so as to rotate relative to the conductor 8.

This allows the rotational force of the double-twist machine 1 to twist strands as they are transmitted from the converging and compacting die 4 to a twist port 16.

In other words, an initial twist is imparted to the conductor 8 at a twist position 13 between the outlet side of the capstan 7 and the inlet side of the double twist machine 1. As in the case of a prior art double twist machine, the conductor 8 has a double-twist imparted thereto once it is fed into the double-twist machine 1 from the twist port 16, and is then taken up on a take-up reel 15 via a drawing device 6 provided inside the double twist machine 1.

As shown in FIG. 2, the resistance caused by the converging and compacting die 4 is reduced as described below. Assuming that $T_0$ represents a force necessary to draw the compact conductor through the converging and compacting die, $\theta$ represents a contact angle between the capstan and the conductor, and $\mu$ represents a frictional resistance between the capstan and the conductor, the relationship between the force $T_0$ and a tension $T_1$ on the outlet side of the capstan is given as $$T_1 = T_0 \cdot e^{-\mu\theta}$$

and hence, $T_1 < T_0$. Thus, the tension in the conductor upstream of the capstan is lower than the tension downstream of the capstan. Normally, a tension $T_2$ inside the double twist machine is double the tension $T_1$ outside the same given as $$T_2 = 2 \times T_1.$$

However, since $T_0$ is less than $T_1$, $T_2$ is prevented from exceeding the breaking tension of the compacted and converged conductor, thus making it possible to twist and compact the strands outside the double twist machine.

However, the shape of the resulting wire will be undesirable if a flat capstan is used. To eliminate undesirably shaped wires, the groove is formed in the periphery of a capstan as shown in FIG. 2. As a result of this, the compact conductor is brought into contact with the sides and bottom of the groove, as shown in FIG. 3, and the shape of the resulting wire is thereby preserved. In addition, the rotation of the twist machine is designed to be transmitted to the converging and compacting die, so that reverse twisting of the strands is prevented, thus making it possible to obtain a compact conductor similar to the one obtainable by a conventional method wherein compaction is effected inside the double-twist machine.

In addition, concentric compact conductors with multi-layer structure can also be obtained by the same method used in obtaining concentric compact conductors with a single-layer structure.

As described above, the double-twist type compact conductor manufacturing apparatus according to the present invention is provided with the drawing device between the double-twist machine and the conductor strand supplying device, the lay plate and the converging and compacting die. This drawing device has the capstan, the peripheral speed of which, is equal to or greater than the pulling speed of the drawing device disposed inside the double-twist machine and which is interlocked with the rotation of the double-twist machine so as to operate in synchronism therewith to rotate at high speed. This capstan has the peripheral groove formed in the outer periphery thereof through which the compact conductor is designed to pass while in contact with the groove. The capstan is, as mentioned above, disposed between the converging and compacting die and the double-twist machine in such a manner that the compact conductor passing through the groove thereof is fed into the double-twist machine in a horizontal fashion. The drawing device disposed outside of the double-twist machine is located at such a position that a predetermined contact angle is formed relative to the conductor.

With the present invention, since the converging and compacting die is disposed outside of the double twist machine, the feeding of conductor strands through the die is easily accomplished. In addition, even conductors with a multi-layer structure can be manufactured in one process as in the case of conductors with a single-layer structure by utilizing the present invention. Moreover, the double-twist machine of the present invention can operate at 100% of its capacity because its rotation speed will not have to be reduced. Thus, the apparatus and method for manufacturing compact conductors according to the present invention ensures double the productivity as compared with prior art compact conductor manufacturing apparatus and methods.

What is claimed is:

1. A method for manufacturing compact conductors, comprising the steps of:

supplying a plurality of conductor strands from a supply device;

converging and compacting said plurality of strands together to form a compact conductor by feeding said plurality of strands into a converging and compacting die downstream of said supply device;

feeding said compact conductor about a capstan having a peripheral groove formed therein such that said compact conductor is received in said groove downstream of said converging and compacting die and such that the shape of said compact conductor is preserved; and imparting a twisting force to said compact conductor by feeding said compact conductor from said capstan downstream to a twist machine.

2. A method as recited in laim 11, further comprising the step of separating said plurality of strands in a diverging manner in a predetermined configuration by passing said plurality of strands through a lay plate downstream of said supply device but upstream from said converging and compacting die.

3. A method as recited in claim 1, wherein said capstan is rotatably driven, and said compact conductor is fed to said twist machine at a speed dependent on the speed of rotation of said capstan.

4. An apparatus for manufacturing compact conductors, comprising:

supply means for supplying a plurality of conductor strands;

converging and compacting means, disposed downstream of said supply means, for converging and compacting said plurality of strands so as to form a compact conductor;

means, comprising a capstan having a peripheral groove formed therein and being mounted downstream of said converging and compacting means, for receiving said compact conductor within said groove so as to feed said compact conductor further downstream while preserving the shape of said compact conductor; and twist means, disposed downstream of said capstan, for imparting a twisting force to said compact conductor.

5. A method as recited in claim 4, further comprising means, comprising a lay plate, mounted downstream of said supply means but upstream of said converging and compacting means, for separating said plurality of conductor strands in a diverging manner in a predetermined configuration.

6. A method as recited in claim 4, further comprising means for rotatably driving said capstan, said compact conductor being fed to said twist means at a speed dependent on the speed of rotation of said capstan.

* * * * *